US005188695A

United States Patent [19]

Colton

[11] Patent Number: 5,188,695

[45] Date of Patent: Feb. 23, 1993

[54] ARTICULATING APPLICATOR HEAD FOR FLAP SEALING UPON CYCLE STOP

[75] Inventor: Douglas E. Colton, Salinas, Calif.

[73] Assignee: Slautterback Corporation, Monterey, Calif.

[21] Appl. No.: 668,861

[22] Filed: Mar. 13, 1991

[51] Int. Cl.[5] ..... B65B 7/00

[52] U.S. Cl. ..... 156/356; 156/357; 156/442.1; 53/76; 53/377.3; 118/684

[58] Field of Search ..... 53/376.5, 377.3, 76; 156/356, 357, 443, 442.1, 475; 118/682, 684

[56] References Cited

U.S. PATENT DOCUMENTS

| | | | |
|---|---|---|---|
| 3,088,433 | 5/1963 | Walter et al. | 118/1 |
| 3,104,986 | 9/1963 | Goman et al. | 118/682 |
| 4,006,579 | 2/1977 | Loveland | 53/376.5 |
| 4,256,526 | 3/1981 | McDaniel | 53/383.1 X |
| 4,480,421 | 11/1984 | Rece | 53/376.5 X |
| 4,673,381 | 6/1987 | Yamamoto et al. | 53/376.5 X |
| 4,894,104 | 6/1990 | Hemus | 53/376.6 X |

*Primary Examiner*—David A. Simmons
*Assistant Examiner*—James J. Engel, Jr.
*Attorney, Agent, or Firm*—Schneck & McHugh

[57] ABSTRACT

A system for use on an automated assembly line having an adhesive applicator disposed to deposit adhesive on cartons progressing along the assembly line. A flap closing device which is utilized only during scheduled or unscheduled cycle stops of the assembly line is operatively associated with a pair of applicator heads. During normal, continuous operation of the assembly line, the flaps of a carton are sealed downstream of the application of adhesive. Effective sealing of all cartons upon a cycle stop is provided by including the second flap closing device at the applicator heads. The applicator heads are within the arc of movement of a carton flap closed by the second flap closing device, but operatively associating the applicator heads with the flap closing device displaces the heads from the path of the flap. Movement of the heads can be a rotational or linear motion.

13 Claims, 3 Drawing Sheets

ARTICULATING APPLICATOR HEAD FOR FLAP SEALING UPON CYCLE STOP

TECHNICAL FIELD

The present invention relates generally to apparatus for adhesive deposition and more particularly to apparatus for sealing cartons on an automated assembly line.

BACKGROUND ART

In the packaging of many items, such as bagged cereal and bottled beer, the items are inserted into cartons from a generally horizontal direction. That is, the items are side loaded, rather than top loaded. Side loading is a more efficient and reliable assembly line method for certain products.

After loading of the product, the opposed ends of the cartons are sealed. An exemplary sealing process includes four adhesive applicators. First and second applicators are aligned on opposite sides of the assembly line and each directs a flow of adhesive onto minor flaps which have been folded to be perpendicular to the carton sides. The first and second applicators function identically to provide the first step in sealing the opposed ends of a carton. A carton then moves downstream of the two applicators and a hinged major flap on each end of the carton is folded to contact the adhesive on the minor flaps. Setting of the adhesive seals the flaps. Further downstream third and fourth adhesive applicators provide a second deposition of adhesive on the minor flaps, whereafter another major flap is folded to contact the second deposition. Typically, each of the four applicators includes two heads. One head deposits adhesive on a forward minor flap, while the other head deposits adhesive on the rearward minor flap. The carton is oriented so that the length of the minor flaps extend in a vertical direction. A hinged major flap that is folded downstream of an applicator has its length parallel to the direction of carton movement.

There are a number of difficulties involved in the above-described automated assembly line process. Adhesive is projected from the applicator heads onto the surfaces of the carton. The velocity of the adhesive must be sufficiently high to insure a reliable positioning of the material on the carton surfaces to minimize adhesive usage. This requires use of relatively small orifices in the outlet nozzles of the applicators. Nozzle orifices in the range of 0.012 to 0.014 inch are common. Moreover, high adhesive pressures of 600 to 700 psi are used. The projection of adhesive over an extended distance from small-orifice, high-pressure applicators causes stringing between adhesive applications. Stringing occurs at the tail end of an application, as the viscosity of the adhesive provides a tendency of released material to urge remaining material from the nozzle orifice. The material strings across the product, the carton and the moving parts of the assembly line. Consequently, the assembly line must be periodically shut down to allow cleaning and preventive maintenance.

The small orifice nozzles have a tendency to plug at an unacceptable rate. This is particularly true in use with hot-melt adhesive, since adhesive material that has been charred will plug a small diameter orifice. Often a nozzle of an applicator head will include more than one orifice. When a portion of the orifices are plugged, the applicator head will continue to seal cartons but the seal will be a marginal one. This leads to a serious quality assurance problem and to damage of the product should the seal give way to the weight of the product.

As described above, the cartons receive a deposit of adhesive and then move downstream of the adhesive application site for closing of a flap. An assembly line problem which is encountered involves the setting of hot-melt adhesive at the application site when the assembly line is stopped for adjustments, modifications or emergencies. If the assembly line cycle stop lasts for a substantial period of time, the adhesive will have set before the major flap is folded into contact with the adhesive. Thus, cartons which are located at application sites during a cycle stop will have a major flap that is free to pivot to an open position. Those cartons must be located and either discarded or individually treated to provide the required seal. Some assembly lines include a cycle-stop flap closing mechanism at each application site. These mechanisms may be pneumatically controlled closure bars which are actuated only upon stoppage of carton travel. The pneumatic bars pivot the major flaps and press the flaps against the surfaces on which adhesive has been deposited. In this manner, setting of the adhesive at the application sites does not result in a defective sealing of a carton. However, pivoting of the major flap will cause contact of the flap with the applicator unless the applicator is spaced apart from the carton by a sufficient distance. At a minimum, the distance must be 1.5 inches. Therefore, the assembly line will be susceptible to the stringing, nozzle plugging, and quality assurance problem described above. Additional problems involve excess material usage and a safety hazard inherent with high pressure adhesive application.

It is an object of the present invention to provide a system for use on an automated assembly line which is clean, safe, cost-efficient and reliable and which insures that all cartons on the assembly line are efficiently sealed despite periodic unanticipated stoppage of assembly line operation.

SUMMARY OF THE INVENTION

The above object has been met by a carton sealing system for an automated assembly line, wherein an adhesive applicator may be placed closely adjacent to cartons on the assembly line so that the applicator is operatively associated with a cycle-stop flap closing device triggered upon temporary shutdown of the assembly line. The operative association includes linking activation of the cycle-stop flap closing device with an assembly for displacing the applicator upon line shutdown. The linking of activation may be mechanical or electrical.

The adhesive applicator defines an application site for a plurality of cartons traveling along the automated assembly line. At least one flap of each carton is in an open position. Typically, the open flap is a major flap, while two minor flaps of the carton are in a closed position. The adhesive applicator deposits material on the closed minor flaps, but could be adjusted to apply the material to major flaps. In normal operation, the carton proceeds downstream from the applicator so that the major flap may be pivoted closed without contacting the applicator which is closely adjacent to the cartons on the assembly line. However, upon sensing a cycle stop of the assembly line due to an emergency or a line adjustment, the cycle-stop flap closing device pivots the major flap of the carton at the adhesive application site. The applicator, which is in the arc of movement of the major flap, is caused to move by the displacement assembly, providing the advantage that the outlet of the applicator may even be brought closely adjacent to the surface upon which adhesive is deposited. In fact, the outlet nozzle may be brought into close proximity to the surface of a minor flap, if desired.

Displacement of the head during cycle stops to permit closing of the major flap is particularly beneficial in the deposition of adhesive in side-loading assembly lines. On such assembly lines, the closed minor flaps are in a vertical position so that the adhesive must be projected along a path in which the major directional component is horizontal. A horizontal projection from a distance which would allow closing of the major flap upon cycle stops requires high pressures and small orifices. The present invention allows both assurance that every carton will be effectively sealed despite occurrences of cycle stops and assurance of a safe, low-maintenance application of adhesive. An increase in safety is the result of horizontal projection at a lower pressure, thereby rendering the system less susceptible to splash back or spattering of hot-melt adhesive.

As a result of use of larger orifice nozzles, the present invention is also less susceptible to plugging of nozzle orifices by charred material or the like. This increases the production time of the assembly line. Moreover, the larger orifice nozzles used at a relatively low pressure do not cause the stringing problems of prior art side-loading assembly line applicators. Another advantage is that the low pressure application and the close proximity to the flaps result in a reduction of use of material. High pressure creates the necessary velocity, but causes deposition of a relatively large bead across the carton surface. The low pressure application of the present invention provides a smaller volume bead of adhesive deposition.

BEST MODE FOR CARRYING OUT THE INVENTION

Figure 1:
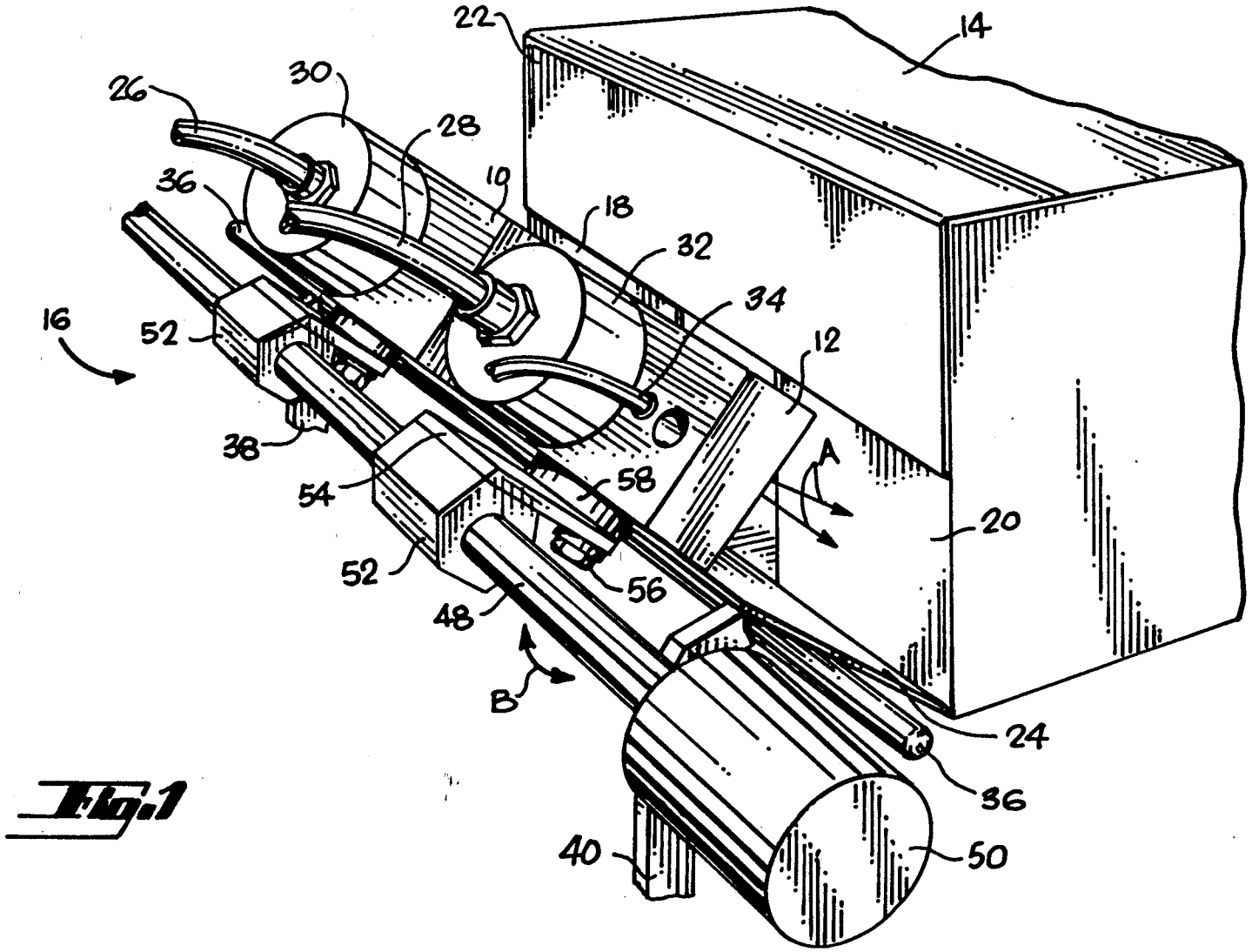
FIG. 1 is a perspective view of an adhesive applicator and a flap closing device of a system in accord with the present invention.

With reference to FIG. 1, side-by-side applicator heads 10 and 12 are shown in position to deposit adhesive on flaps of a carton 14. The carton is one of a stream of containers progressing along an automated assembly line past an adhesive application station 16 shown in FIG. 1. While the carton is shown as being a corrugated box, "cartons" may also include containers made of other materials.

A carton 14 progressing along the assembly line rests on one side of the carton. Side loading of certain products, such as beer, has been found to be the most reliably effective method. After loading of a carton 14, the carton is sealed by four adhesive application stations identical to the station 16 of FIG. 1. First and second stations, not shown, are located on opposite sides of the assembly line to apply adhesive to the upper portions of four minor flaps 18 and 20 on the carton 14. The carton 14 then progresses downstream of this first pair of stations, whereupon opposed upper major flaps 22 are pivoted downwardly to contact the portions of the minor flaps 18 and 20 which received adhesive from the first pair of stations. The upper major flaps 22 are securely fastened to the minor flaps upon setting of the adhesive. Because FIG. 1 illustrates one end of the carton, only two of the minor flaps 18 and 20 and one upper major flap 22 are shown.

Downstream of the device which closes the upper major flaps 22 is a second pair of adhesive application stations, only one 16 of which is shown. These stations apply adhesive to the lower portions of the minor flaps 18 and 20. Each of the applicator heads 10 and 12 of the station 16 is controlled to apply material to only one of the minor flaps. That is, the forward applicator head 10 applied adhesive to the forward minor flap 18, while the rearward applicator head 12 applied a pair of beads of a adhesive to the rearward minor flap 20, as shown by arrows A. The carton then travels past the station 16 for closure of the lower major flaps 24. Closure of the lower major flaps brings the flaps into contact with the adhesive on the minor flaps 18 and 20, thereby providing the required seal upon setting of the adhesive. Typically, the adhesive material is a hot-melt material which is thermosetting. However, side-loading of the cartons 14 and thermosetting adhesive is not critical to the present invention.

Thus, continuous operation of the assembly line includes five spatially and operationally distinct steps of firstly loading the carton 14, secondly applying the adhesive to the upper portions of the minor flaps 18 and 20, thirdly closing the upper major flaps 22, fourthly applying adhesive to the lower portions of the minor flaps, and lastly pivoting the lower major flaps 24 into contact with the minor flaps. After setting of the adhesive material, the carton 14 may be set upright and shipped to its destination.

As noted above, each of the four adhesive application stations 16 includes a pair of applicator heads 10 and 12 for separate deposition of material on the forward and rearward minor flaps 18 and 20. An applicator head receives adhesive from a hose 26 and 28 of a supply, not shown. Solenoids 30 and 32 are selectively activated to control flow from the hoses 26 and 28 to outlets for depositing adhesive on the carton 14. Each applicator head 10 and 12 includes heater elements which receive electrical power via a cable 34. The heater elements maintain the temperature of the applicator heads above the melting temperature of the hot-melt adhesive.

While the five-step process for sealing goods within the carton 14 functions efficiently during continuous operation of the assembly line, a problem is encountered during shutdown of the assembly line. A carton which is stopped at an adhesive application station 16 will include hot-melt adhesive on the minor flaps 18 and 20. Even a momentary cycle stop of the assembly line will cause some setting of the hot-melt material. The setting of adhesive will jeopardize the sealing of the carton, since downstream pivoting of the lower major flap 24 will be at a time subsequent to some or all of the thermosetting. For this reason, some assembly lines include cycle-stop flap closing devices which are activated only upon ceasing of carton movement along the assembly line. A flap closure bar 36 is shown in contact with the lower major flap 24. Typically, the major flap is biased in n open position by the memory of the corrugated material. The closure bar 36 may be positioned to maintain the major flap 24 in the partially closed position shown in FIG. 1, but preferably has a rest position in which a major flap 24 is perpendicular to the minor flaps 18 and 20. When a cycle stop of the assembly line is sensed, the closure bar 36 is pivoted upwardly and presses the major flap 24 against the minor flaps 18 and 20 which have received adhesive from the applicator heads 10 and 12. Pivoting of the closure bars may be at ends of a pair of brackets 38 and 40.

Inclusion of a second flap closing device, i.e., closure flap 36, for each of the four application stations 16 will insure that all of the cartons 14 are adequately sealed regardless of periodic cycle stops. A problem which is encountered, however, is that a possibility of flap closures a the application sites requires that the applicator heads 10 and 12 be spaced at a position out of the arc of possible movement of the major flaps. While the distance from the adhesive outlet to the carton may be only three inches, the spacing requires that the adhesive be projected at a high velocity. Small nozzle orifices in the range of 0.012 to 0.014 inch and high pressures of 400 to 700 psi are used to achieve the necessary velocity. However, the small orifices and high pressures result in nozzle-plugging, adhesive-stringing and equipment reliability problems and create a safety hazard.

Figure 2:
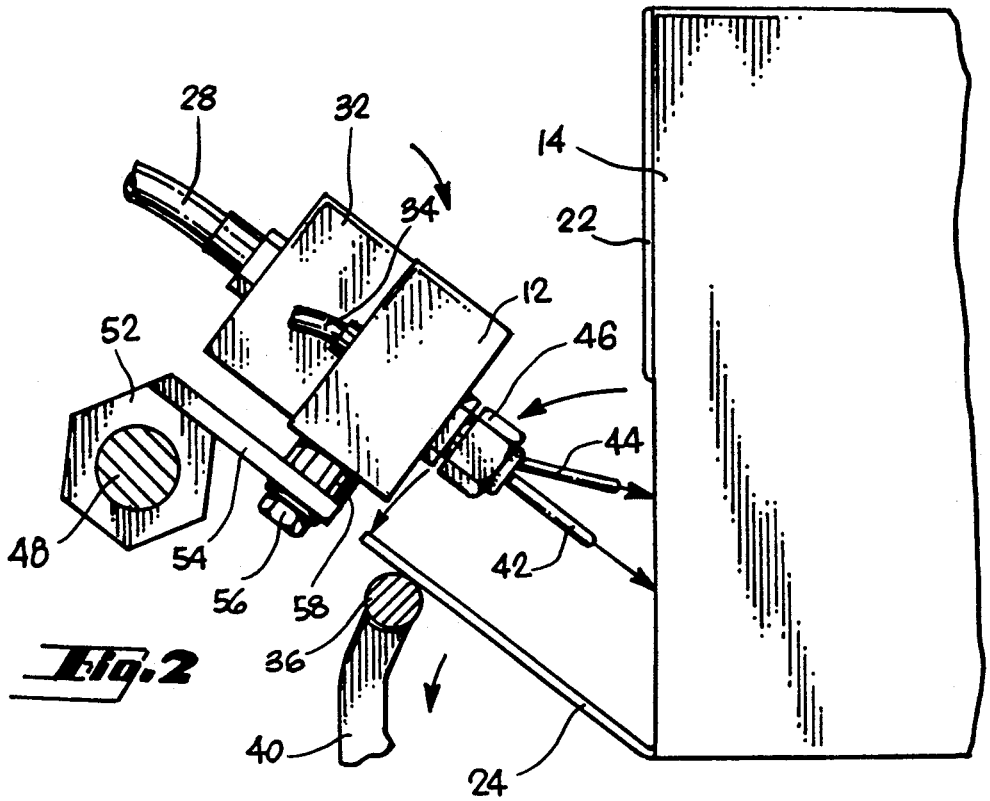
FIG. 2 is a side view of the system of FIG. 1 shown in an operational position.

Referring now to FIGS. 1 and 2, the present invention overcomes the problems encountered in the prior art by operatively coupling the cycle stop closure bar 36 and the applicator heads 10 and 12. The operative coupling allows nozzle outlets 42 and 44 to be brought in close proximity to the flap of a carton 14 so that the release of adhesive from the applicator heads may even be close to contact with the surface of the carton 14 on which adhesive is deposited. For example, by placing nozzle outlets 42 and 44 in a position of 0.5 inch from the carton, the present invention is able to reduce the adhesive pressure required to project the adhesive onto the carton. With adhesive pressures in the range of 275–400 psi, a nozzle outlet having an orifice of 0.020 inch may be utilized. In FIG. 2, the applicator head 12 is shown as having a nozzle 46 with a pair of outlets 42 and 44 which are elongated to reduce the flow of adhesive that forms the two beads on the carton flap. A long engagement nozzle reduces the amount of adhesive used. The larger orifice nozzle is less susceptible to plugging and provides a straight-through adhesive flow which is less likely to create charred material than applicator heads which allow circulation of adhesive.

The applicator heads 10 and 12 are mounted to a rotatable shaft 48. The shaft is caused to be rotated about the axis of the shaft by an actuating motor 50, as seen by arrow B. Alternatively, the actuating device may be a pneumatic cylinder which is linked to the brackets 38 and 40 that operate the flap closure bar 36. As best seen in FIG. 2, a hexagonal member 52 has an internal bore which receives the rotatable shaft 48. The hexagonal member may be fixed in place along the shaft by set screws or other means known in the art. Preferably, the hexagonal member 52 is able to relocate along the length of the shaft to accommodate cartons of various sizes. A bracket 54 has one end fixed to one surface of the hexagonal member 52 and has an opposite end fixed to the applicator head 12 by a bolt 56. A spacer 58 is mounted between the bracket 54 and the applicator head 12.

Figure 3:
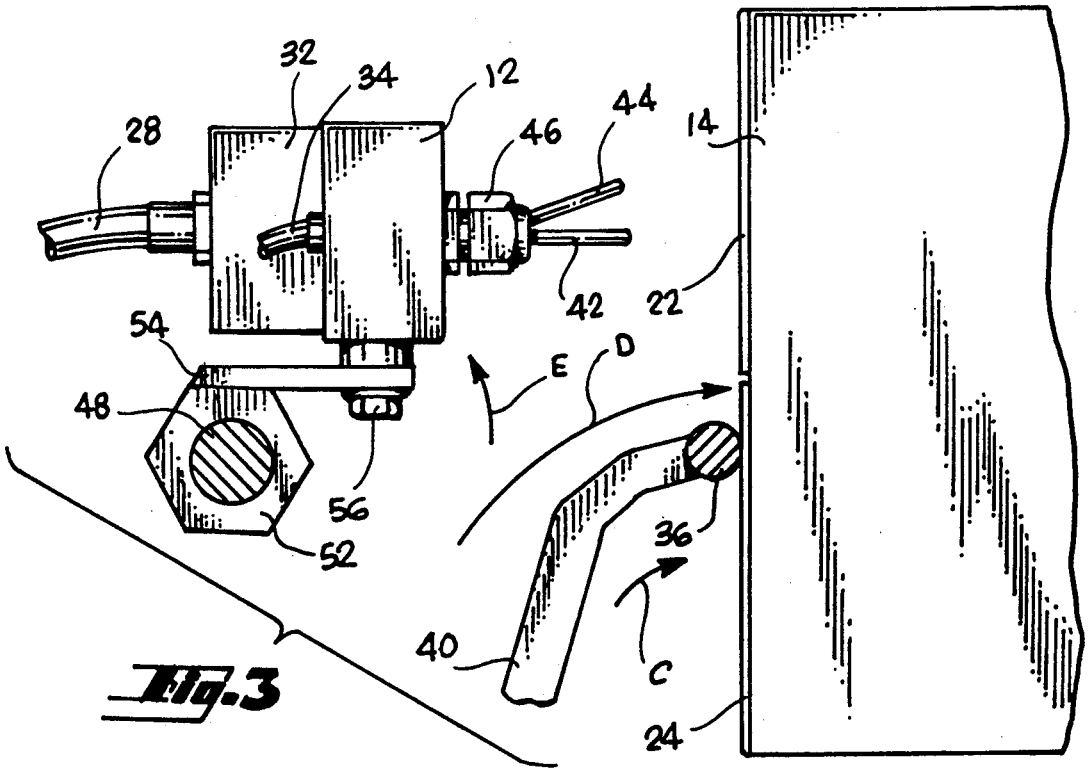
FIG. 3 is a side view of the system of FIG. 1 in a cycle stop position.

During continuous operation of an assembly line, the applicator head 12 and the flap closure bar 36 remain in the position shown in FIG. 2. However, upon occurrence of a scheduled or unscheduled cycle stop of the assembly line, a first actuating device, not shown, triggers the flap closure bar 36 to move to the position shown in FIG. 3. Movement of the closure bar 36, shown by arrow C, causes the lower major flap 24 to pivot at its hinge and follow the arc shown by arrow D. This arc of travel would be impeded by the position of the applicator head 12, but a cycle stop on the assembly line is accompanied by a rotation of the shaft 48 that supports the applicator head 12. Rotation of the shaft moves the applicator head into the cycle stop position shown in FIG. 3. In this position, the end of the major flap 24 is able to follow the path shown by arrow D without contacting the applicator head. Movement of the applicator head 12 is indicated by arrow E.

In operation, cartons 14 will continually progress past the adhesive application station 16 shown in FIG. 1, as well as three other stations. The stations are substantially identical. After receiving beads of adhesive from the two applicator heads 10 and 12, the carton continues to a downstream position in which a major flap 24 is pivoted to contact the beads of adhesive on the minor flaps 18 and 20. The adhesive application stations insure proper sealing of the carton, whereafter the carton can be shipped to its destination.

However, the present invention includes an operative coupling of the flap closure bar 36 and the applicator heads 10 and 12 to provide effective sealing when the assembly line is stopped. Upon such a cycle stop, the applicator heads are pivoted from the application position shown in FIG. 2 to the nongluing position shown in FIG. 3. Either simultaneously or at a time immediately following pivoting of the applicator heads, the closure bar 36 provides a force for closing the major flap 24. Thus, the beads of adhesive deposited by the applicator heads is not allowed to set prior to closing of the flap.

Figure 4:
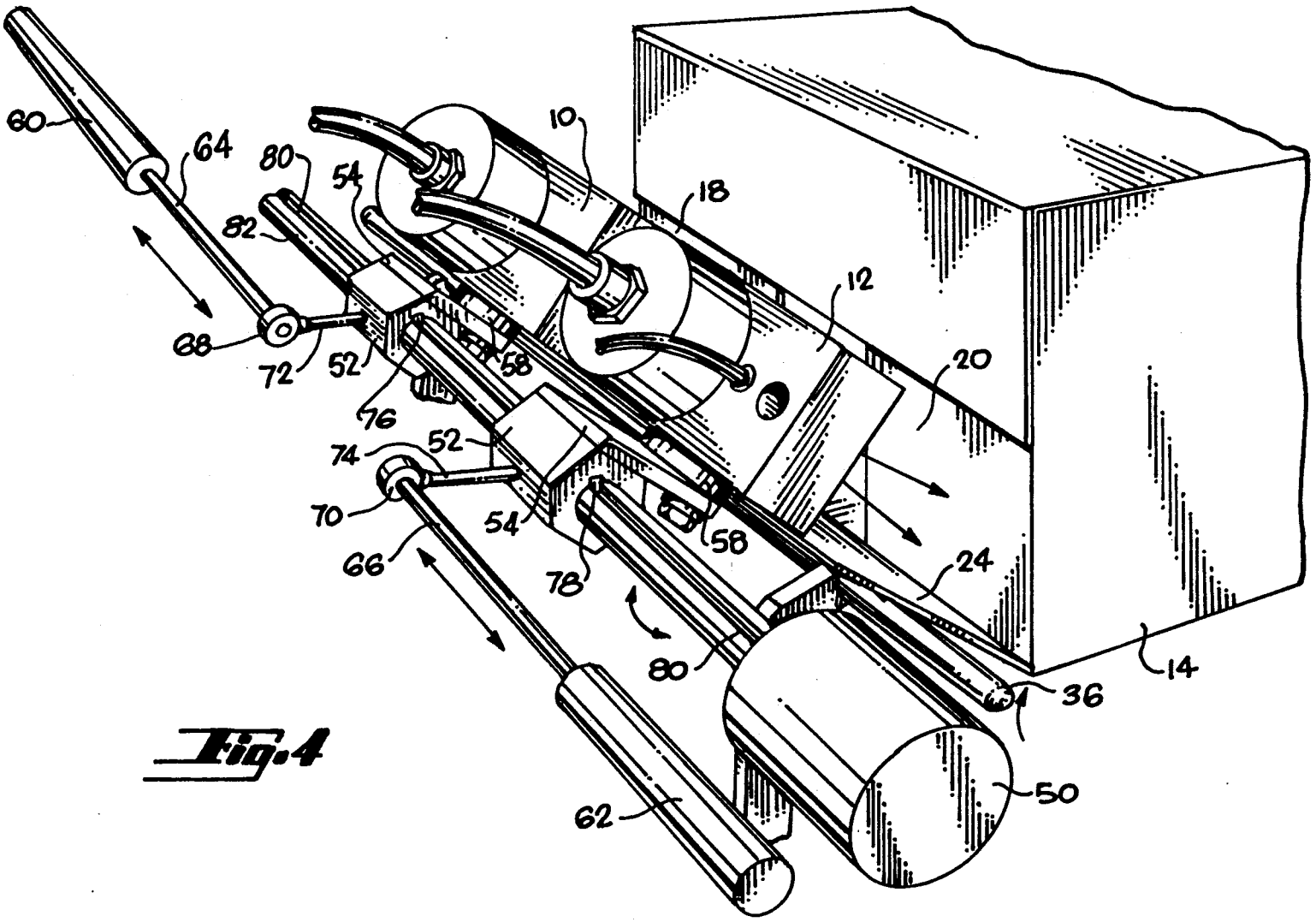
FIG. 4 is a perspective view of a second embodiment of the present invention.

Referring now to FIG. 4, a second embodiment for moving the applicator heads 10 and 12 from the arc of movement of the lower major flap 24 is shown. In this embodiment the heads are again mounted to hexagonal members 52 by means of a bracket 54 and a spacer 58, but the hexagonal members are linked to pneumatic cylinders 60 and 62. Reciprocating rods 64 and 66 extend from the pneumatic cylinders to provide positioning of the applicator heads 10 and 12. The reciprocating rods terminate at pivot joints 68 and 70 and are connected to linkages 72 and 74.

Each of the hexagonal members 52 has a notch 76 and 78 at its inside diameter to receive and ride along a keyway 80 that rises from the shaft 82. At a cycle stop of the assembly line, the pneumatic cylinders 60 and 62 are actuated to retract the reciprocating rods 64 and 66 into the pneumatic cylinders. The retraction causes the pneumatic heads 10 and 12 to separate. The applicator heads are displaced to a position in which the heads are no longer in the arc of movement of the lower major flap 24. The flap closure bar 36 may then be triggered to press the lower major flap 24 against the adhesive applied to the minor flaps 18 and 20 by the applicator heads.

The linear movement of the applicator heads 10 and 12 in FIG. 4 replaces the rotational motion described above. However, it may be desirable to include a rotational movement of the applicator head to insure clearance for the movement of the lower major flap 24. In such a case, the actuating motor 50 may be utilized to rotate the shaft 82. An advantage of use of the motor 50 which rotates the shaft 82 is that the actuation of the flap closure bar 36 may be directly tied to rotation of the applicator heads 10 and 12 by linking the shaft 82 to the closure bar 36.

I claim:

1. A carton sealing apparatus for use on an automated assembly line having a plurality of cartons moving past an adhesive application site to a downstream first means for closing a first hinged flap on said cartons, said apparatus comprising, outlet means at said application site for projecting pressurized adhesive onto said cartons progressing along said automated assembly line, means coupled to said outlet means for terminating projection of pressurized adhesive from said outlet means upon discontinuance of movement of said cartons past said application site, second means for closing said first hinged flap on a carton at said application site, said first closing means being utilized during normal operation of said automated assembly line and said second closing means operative upon discontinuance of movement of said cartons past said application site, said outlet means disposed within the path of said first hinged flap closed by said second closing means, said outlet means and said second closing means being mounted to pivot along axes generally parallel to the direction of said cartons progressing along said automated assembly line, and means for displacing said outlet means from said path of said first hinged flap for a closure by said second closing means, said displacing means being operatively associated with said second closing means in that said outlet means and said second closing means are pivoted upon said discontinuance of carton movement.

2. The apparatus of claim 1 wherein said outlet means is in fluid communication a source of hot-melt adhesive.

3. The apparatus of claim 1 wherein said second closing means is upstream of said first closing means, said outlet means being fixed to a rotatable shaft, said rotatable shaft being generally parallel to said direction of progressing cartons, said displacing means coupled to said rotatable shaft to selectively pivot said rotatable shaft.

4. The apparatus of claim 1 said outlet means includes a nozzle directed extrude adhesive onto a generally vertical second flap of said carton, said closing of said first hinged flap being a pivoting of said first hinged flap to a generally vertical position.

5. The apparatus of claim 4 wherein said nozzle is spaced apart from said second flap, said extrusion being a pressurized release of adhesive for an on-the-fly deposition.

6. The apparatus of claim 1 wherein said outlet means includes first and second adhesive outlets spaced apart from each other in the direction of carton movement by a distance to allow said first adhesive outlet to deposit material onto a forward minor carton flap and said second adhesive outlet to deposit material onto a rearward minor carton flap, said first hinged flap being a major carton flap.

7. An automated assembly line for the sealing of cartons traveling along said assembly line comprising, an adhesive outlet nozzle disposed to be in close proximity to said cartons for depositing adhesive on a first flap of each of said cartons, said outlet nozzle being generally fixed with respect to a direction of carton travel, a first flap closure device downstream of said outlet nozzle for pivoting a second flap of each carton into contact with said deposition of adhesive on said first flap, means for sensing a stopping of carton travel past said outlet nozzle, and means operatively associated with said sensing means for substantially simultaneous pivoting said second flap of a carton which is located closely proximate to said outlet nozzle and pivoting said outlet nozzle away from said first flap of said carton upon said sensing of stoppage of carton travel, said pivoting of said second flap pressing said second flap onto said first flap, said means for pivoting said second flap being generally fixed with respect to said direction of carton travel.

8. The assembly line of claim 7 wherein said means for moving said outlet nozzle includes a pneumatic cylinder coupled to said outlet nozzle.

9. The assembly line of claim 7 wherein said first flap is in a generally vertical position, said nozzle outlet having an extrusion orifice directed to apply adhesive to said vertical first flap, the diameter of said extrusion orifice being greater than 0.015 inch.

10. The assembly line of claim 7 wherein said deposition of adhesive from said outlet nozzle is at a pressure less than 400 psi.

11. The assembly line of claim 7 wherein said outlet nozzle is in fluid communication with an electrically valved source of adhesive.

12. The assembly line of claim 7 wherein said means for pivoting said second flap includes a closure bar, said outlet nozzle and said closure bar being fixed with respect to said direction of carton travel.

13. The assembly line of claim 7 further comprising means for discontinuing the depositing of adhesive upon said sensing of stopping of carton travel.

* * * * *